United States Patent [19]

King

[11] 4,004,526

[45] Jan. 25, 1977

[54] DETACHABLE RACK ANCHOR

[75] Inventor: Clarence J. King, Ludington, Mich.

[73] Assignee: Straits Steet & Wire Co., Ludington, Mich.

[22] Filed: Dec. 1, 1975

[21] Appl. No.: 636,636

[52] U.S. Cl. ..... 108/114; 108/149; 108/152; 211/90; 211/106; 248/239; 248/249; 248/250

[51] Int. Cl.[2] ..... A47B 3/00

[58] Field of Search ..... 108/108, 109, 64, 114, 108/149, 152, 134, 135; 211/88, 90, 106, 181, 148; 248/235, 239, 227, 234, 249, 250

[56] References Cited

UNITED STATES PATENTS

| | | | |
|---|---|---|---|
| 1,552,214 | 9/1925 | Carlin | 248/249 |
| 2,546,587 | 3/1951 | Eisenberg | 108/152 |
| 2,746,609 | 5/1956 | Welsh | 108/149 |
| 3,490,393 | 1/1970 | Nelson | 248/250 X |

*Primary Examiner*—James C. Mitchell
*Attorney, Agent, or Firm*—Price, Heneveld, Huizenga & Cooper

[57] ABSTRACT

A plurality of anchors are secured to a vertical support surface in a horizontally spaced relationship. A plurality of racks or shelves are detachably suspended between the anchors by an inner hanger and an outer hanger. The anchors and hangers permit the ends of adjacent racks to be suspended at a single point.

5 Claims, 10 Drawing Figures

DETACHABLE RACK ANCHOR

BACKGROUND OF THE INVENTION

This invention relates to article supports attachable to vertical surfaces, and more particularly it concerns a detachable anchor and rack assembly whereby a plurality of racks may be suspended along the face of a wall in the same horizontal plane.

Various types of arrangements have been proposed whereby an article supporting rack or shelf may be mounted on a wall or other vertical surface in order to provide storage and/or display space for books, plants, and various other miscellaneous articles. One such arrangement involves the use of vertically extending, horizontally spaced, slotted channels or standards which are secured to the face or vertical surface of a wall. Cooperating attachment or suspension members are secured to a rack or shelf and are adapted to be inserted within the slots formed in the support channel members to thereby suspend the rack or shelf between the support members. Although providing an acceptable arrangement for storing or displaying articles along a wall, the slotted channels are not readily adaptable for supporting a plurality of racks or shelves immediately adjacent each other in a horizontal plane. This primarily results from the fact that the slots are dimensioned to receive only a single hook or support bracket thereby necessitating the use of a separate pair of standards to support each rack or shelf.

SUMMARY OF THE INVENTION

In accordance with the present invention, a simple, easily manufactured, aesthetically pleasing and easily mounted detachable rack and anchor arrangement is provided. Essentially, a plurality of anchors are secured to a vertical support surface or face of a wall in a horizontally spaced relationship. Each anchor includes a head portion and a shank portion. A plurality of wire frame racks are provided each having a vertical support portion at each end. An outer hanger having an inverted hook portion extends parallel to the wall from one of the vertical support portions of the wire frame rack. A inner hanger having an inverted hook extends parallel to the wall from the other vertical support portion of each of the wire frame racks. Each of the anchors is adapted to detachably support adjacent ends of the horizontally extending racks by the outer hanger and inner hanger.

DETAILED DESCRIPTION OF THE PREFERRED EMBODIMENT

Figure 1:
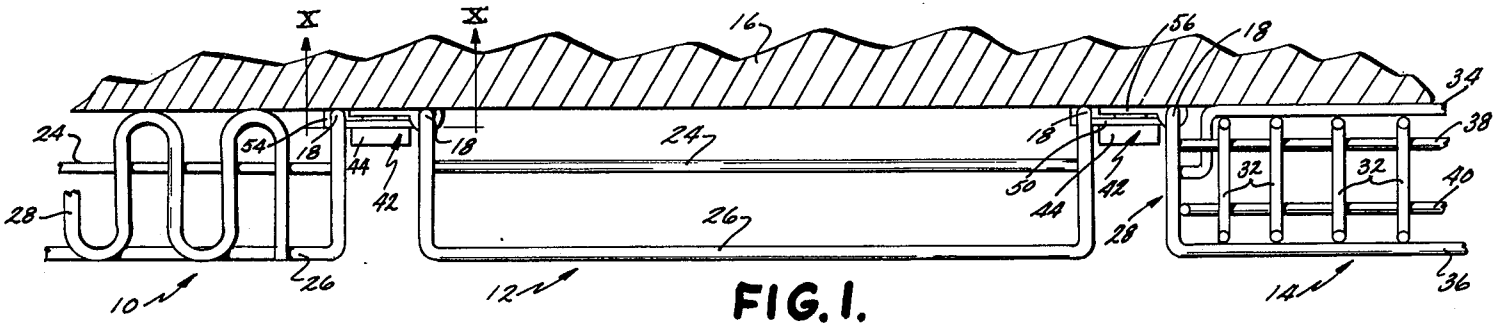
FIG. 1 is a fragmentary plan view of a detachable rack and anchor assembly in accordance with the present invention.
Figure 2:
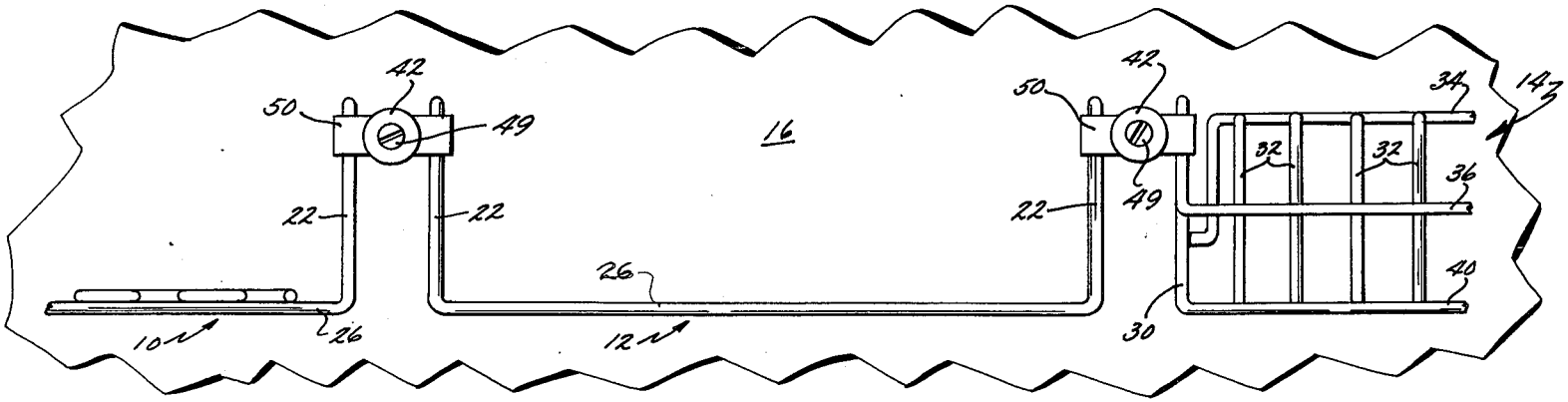
FIG. 2 is a fragmentary front elevation of the detachable rack and anchor assembly.
Figure 8:
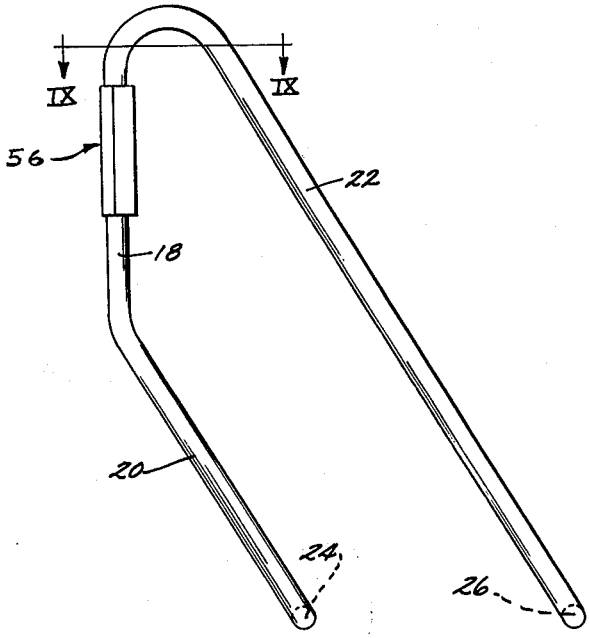
FIG. 8 is a side elevation of a rack in accordance with the present invention.

With reference to the drawings, FIGS. 1 and 2 show a detachable rack and anchor assembly in accordance with the present invention. A plurality of different wire type racks or shelves 10, 12 and 14 are supported along the face of a wall 16 in the same horizontal plane. Racks 10 and 12 are both formed from a length of rod or wire and include ends having a vertical support, wall engaging portion 18 (see FIG. 8). A depending angled portion 20 is integral with the lower end of the vertical wall engaging portion 18. An outer leg portion 22 is integral with the upper end of the portion 18. An inner support 24 connects the lower ends of the angled legs 20 and an outer support 26 connects the lower ends of the outer legs 22. The frame comprised of the portions 18, 20, 22, 24 and 26 is preferably formed as a closed loop from a single strand of wire-like metal such as steel with the ends of the strand butt welded. Rack 10 is illustrated as including a repeating S-shaped grill 28 supported on and between the inner support 24 and the outer support 26 (FIGS. 1 and 2).

Rack 14 is a basket-type wire rack assembly (FIGS. 1 and 2). The basket frame includes end portions 28 having a vertically extending, wall engaging support leg 30. A plurality of generally U-shaped members 32 are disposed between back and front defining wires 34 and 36. Members 32 rest on inner and outer support wires 38, 40 respectively.

Figure 7:
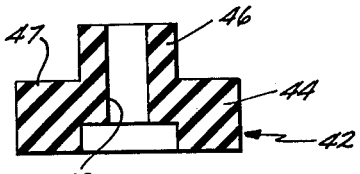
FIG. 7 is a cross-sectional view of the anchor button.

A plurality of anchors 42 are secured to the face of the wall 16 in spaced relationship and in the same horizontal plane. As best seen in FIGS. 1 and 7, each anchor includes a head or stop portion 44 and a hub or shank portion 46.

The stop 44 and the hub 46 are illustrated as having cylindrical shapes. Other shapes may be employed in the practice of the subject invention, the only requirement being that the outer head or stop portion 44 have a greater width or diameter than the inner hub portion 46 to thereby define a stop surface or shoulder 47.

The anchor 42 includes a bore 48 which is counterbored or enlarged at the face of the head portion 44. Each anchor 42 is secured to the wall 16 by a suitable fastener 49 extending through the bore 48 (FIG. 2). Due to the counter-bore arrangement, the head of the fastener will be flush with the face of the head portion 44 of the anchor 42.

Figure 3:
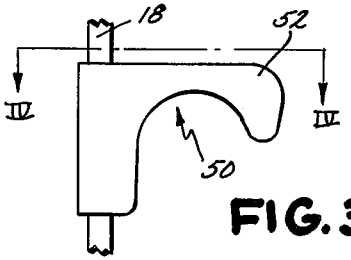
FIG. 3 is an enlarged fragmentary front view of the outer hanger for the rack.
Figure 4:
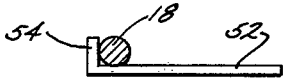
FIG. 4 is a cross-sectional view taken along line IV—IV of FIG. 3.
Figure 9:
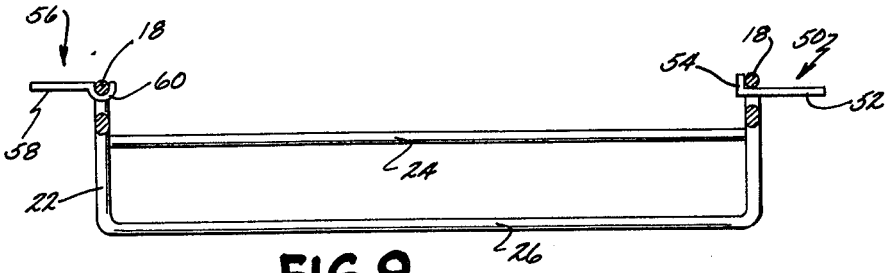
FIG. 9 is a cross-sectional view taken along line IX—IX of FIG. 8.

Each rack 10, 12 and 14 is provided on one end with an outer hanger 50. As best seen in FIGS. 3 and 4, the outer hanger includes an inverted hook portion 52 and a right angle tab 54. As illustrated in FIGS. 1 and 9, the outer hanger 50 is secured to the right side vertical support, wall engaging portion of each rack assembly, with the tab partially wrapped around the rod-like vertical support and attached by suitable means such as welding. As best seen in FIG. 9, the end face of the right angle tab 54 can be adapted to abut against the face of the wall 16 and the inverter hook portion 52 of the outer hanger 50 extends outwardly from the rack 10 in a parallel, spaced relationship with the wall 16. The abutment of the end of the tab 54 to the wall is not essential.

Figure 5:
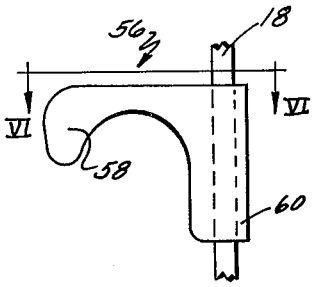
FIG. 5 is a fragmentary view of the inner hanger for the rack.
Figure 6:
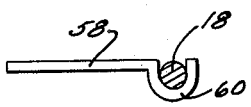
FIG. 6 is a cross-sectional view taken along line VI—VI of FIG. 5.

An inner hanger 56, as shown in FIGS. 5, 6 and 9 is secured to the other rack vertical support, wall engaging portion 18. The inner hanger 56 likewise includes an inverted hook portion 58. However, the inverted hook portion 58 is integral with a semi-cylindrical tab 60, as opposed to the right angle tab 54 of the outer hanger 50. The tab 60 wraps partially around the rod-like wall engaging portion of the rack and is secured by suitable means such as welding. As shown, the inner hanger 56 extends outwardly from the rack with the vertical support, wall engaging portion of the rack secured within the semi-cylindrical tab 60.

As is readily apparent, the inner and outer hangers are items readily made by stamping. The anchors 42 may be readily molded from plastic or machined from bar stock.

Figure 10:
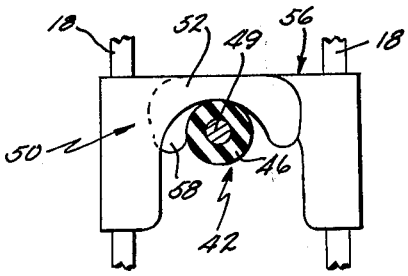
FIG. 10 is a cross-sectional view taken along line X—X of FIG. 1.

As seen in FIGS. 1 and 10, the inner hanger and outer hanger of adjacent ends of a pair of racks such as the racks 10 and 12 or the racks 12 and 14 are hooked over the shank portions 46 of the anchors 42. The inverted hook portion 58 of inner hanger 56 is sandwiched between the face of the wall 16 and the inverted hook portion 52 of the outer hanger 50. The head or stop 44 of the anchor 42 retains the inner and outer hangers on the shank portion 46. The vertical support, wall engaging portions 18 of each of the racks provide the assembly with horizontal stability.

The anchors 42 and inner and outer hangers 56, 50 respectively permit the easy mounting of various types of wire rack frames across the face of a wall. Due to the fact that only a single anchor 42 need be provided to support the ends of adjacent racks, a simple, uncluttered, easily mounted shelving or rack system is provided.

The anchors 42 and the inner hangers/outer hangers 56, 50 permit ready removal of the different racks 10, 12 and 14 from the wall 16. This feature allows ready substitution of different racks as display or storage requirements dictate. The overall assembly results in a reduction in the amount of hardware normally necessary for mounting conventional shelving as well as a reduction in installation time. This is particularly convenient when the invention is used as display shelving under circumstances requiring frequent changes.

Thus it will be appreciated that the present invention provides an improved detachable rack and anchor assembly having ease of manufacture, ease of installation, the capability to adapt various types of racks for wall mounting while providing a simple and aesthetically pleasing arrangement. It is expressly intended, therefore, that the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows:

1. A detachable rack and anchor assembly mountable on a vertical support surface, comprising:

a plurality of anchors adapted to be secured to the vertical support surface in a horizontally spaced relationship, said anchors each having an outer stop portion and an inner shank portion;

a rack including at each end a vertical support engaging portion;

an outer hanger attached to one of such vertical support engaging portions of said rack; and an inner hanger attached to the outer of said vertical support engaging portions of said rack, said inner hanger and said outer hanger each engaging one of said anchors to thereby detachably mount said rack on said vertical support surface, said outer hanger including a hook portion for engaging said shank portion of one of said anchors and an integral right angled tab portion secured to one of said vertical support engaging portions of said rack so that said inverted hook portion of said outer hanger extends outwardly in a parallel spaced relationship to the vertical support surface, said inner hanger including an inverted hook portion for engaging said shank portion of another of said anchors and an integral cylindrical tab portion, said cylindrical tab portion receiving and being secured to the vertical support engaging portion of said rack, so that said inverted hook portion of said inner hanger engages the vertical support surface.

2. A display and storage assembly for attachment to the face of a wall, capable of supporting books, plants, and various other miscellaneous articles, comprising:

a plurality of anchors adapted to be secured to the face of the wall;

a plurality of shelves each having opposite ends, a first hanger attached to one end and a second hanger attached to the other end, each of said hangers of each of said shelves suspending each rack between a pair of said anchors with the ends of adjacent shelves supported by a common anchor, said hanger includes a hook-shaped portion adapted to engage said shank portion of one of said anchors and an integral right angled tab portion secured to one of said shelves to that said inverted hook-shaped portion of said hanger extends longitudinally in a parallel, spaced relationship to the face of the wall; and wherein said second hanger includes a hook portion adapted to engage said shank portion of one of said anchors and an integral cylindrical tab portion, said cylindrical tab portion secured to the other end of each of said shelves whereby said hanger of the end of one shelf sandwiches said other hanger of the end of an adjacent shelf with the face of the wall on said shank portion of said anchor.

3. A display and storage assembly as defined by claim 2, wherein said anchors each include an outer stop portion and an inner shank portion, each end of said racks being suspended from said shank portion of said anchor by said hanger and by said second hanger.

4. A display and storage assembly as defined by claim 3, wherein each of said shelves includes at each of said shelf ends a vertical support engaging portion, and each of said first hanger and said second another hanger being secured to one of said vertical support engaging portions.

5. A wall hung rack having a main frame of generally U-shaped configuration as viewed from the front with the sides of said "U" forming the ends of said frame; each of the ends of said frame having a pair of upwardly extending, rearwardly inclined, generally parallel members joined through a vertically extending portion at the rear thereof; said lower ends of corresponding ones of said parallel members being joined by interconnecting base portions; said entire main frame being a single endless loop of rod-like material; a pair of hanger brackets, one secured to each of said vertical portions adjacent the upper end thereof; each of said hanger brackets having an outwardly extending, hook shaped, wall paralleling portion, said portions of said brackets being offset from each other in planes parallel to the wall engaging surfaces of said vertical portions substantially the thickness of said vertical portions.

* * * * *

UNITED STATES PATENT AND TRADEMARK OFFICE

CERTIFICATE OF CORRECTION

PATENT NO. : 4,004,526

DATED : January 25, 1977

INVENTOR(S) : Clarence J. King

It is certified that error appears in the above-identified patent and that said Letters Patent are hereby corrected as shown below:

Column 4, line 50:

Delete "another".

Signed and Sealed this

Fourteenth Day of June 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 4,004,526
DATED : January 25, 1977
INVENTOR(S) : Clarence J. King

It is certified that error appears in the above-identified patent and that said Letters Patent are hereby corrected as shown below:

Column 3, line 67:

"outer" should be --other--.

Signed and Sealed this thirtieth Day of August 1977

[SEAL]

*Attest:*

RUTH C. MASON
*Attesting Officer*

C. MARSHALL DANN
*Commissioner of Patents and Trademarks*